US007766621B1

(12) United States Patent
Maggs et al.

(10) Patent No.: US 7,766,621 B1
(45) Date of Patent: Aug. 3, 2010

(54) SPLIT SHANK ROTOR BLADE

(75) Inventors: Peter J Maggs, Bath (GB); Steven M Bagnall, Bristol (GB); Neil M Evans, Bristol (GB)

(73) Assignee: Rolls-Royce PLC, London (GB)

( * ) Notice: Subject to any disclaimer, the term of this patent is extended or adjusted under 35 U.S.C. 154(b) by 1826 days.

(21) Appl. No.: 08/545,540

(22) Filed: Nov. 16, 1995

(30) Foreign Application Priority Data

Nov. 30, 1994 (GB) ..... 9424172.6

(51) Int. Cl.
*F01D 5/12* (2006.01)

(52) U.S. Cl. ..... 416/193 A; 416/217; 416/248; 416/239

(58) Field of Classification Search ..... 416/193 A, 416/500, 239, 217, 248, 223 R
See application file for complete search history.

(56) References Cited

U.S. PATENT DOCUMENTS 2,790,620 A * 4/1957 Rankin ..... 416/217
3,501,249 A * 3/1970 Scalzo et al. ..... 416/193 A
5,183,389 A * 2/1993 Gilchrist et al. ..... 416/193 A
5,369,882 A * 12/1994 Dietz et al. ..... 29/889.1

FOREIGN PATENT DOCUMENTS

DE 2027861 * 12/1971 ..... 416/193 A
JP 55-134703 A * 10/1980 ..... 416/193 A

* cited by examiner

*Primary Examiner*—Ninh H Nguyen
(74) *Attorney, Agent, or Firm*—Oliff & Berridge, PLC

(57) ABSTRACT

A shroudless turbine rotor blade of the type having a platform damper interface, is provided with at least one slot which extends from the aerofoil side of a platform flow boundary to a point in the root. The slot extends between opposing flanks of the blade so as to divide the platform and partially divide the root. The segregated root is made more flexible by the slot which provides for greater platform vibratory amplitudes for a given length of root. The increased platform motion provides for improved dampability when the blade vibrates. The slot also provides a pair of confronting platform surfaces which are urged into mutual contact by centrifugal load acting on the blade to create an additional damping interface.

10 Claims, 2 Drawing Sheets

SPLIT SHANK ROTOR BLADE

Figure 1:
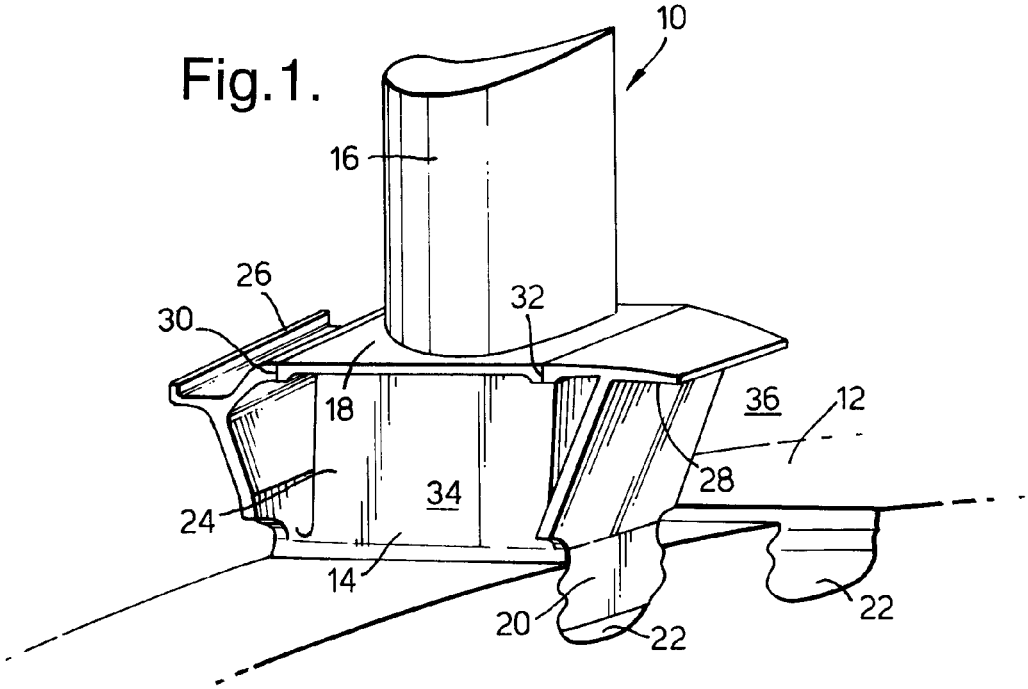

This invention relates to turbine and compressor rotor blades. In particular the invention concerns improvements to damped shroudless rotor blades.

In bladed rotor assemblies there is a general requirement to reduce blade fatigue by limiting blade vibrations at or near resonance. In many situations the effects of blade vibratory motion are lessened by using shrouds to alter, the frequency characteristics of the blade. There are many applications of blade shrouds, but in recent years, at least, there has been a move to reduce rotor assembly weight by removing the blade shroud and applying a friction damping function to the blade platform.

Underplatform-damping is one method by which blade vibratory effects are lessened in shroudless rotor assemblies. In this method a movable damper element is positioned on the underside of a blade platform. The damper operationally engages the underside of the platform when the rotor rotates, and creates a friction damping effect at the platform interface when the blades vibrate.

A problem with this and other platform damping methods is that in order to create an effective damper the blade root must be flexible enough to permit relatively high vibratory amplitudes at the platform, yet strong enough to support the operational loads acting on the blade.

With modern high performance blades it has been the practice to provide the blade root with an extended shank portion, and to achieve the necessary root flexibility by dimensioning the shank spanwise height in accordance with the desired level of platform motion. This approach is preferred as it enables root flexibility to be increased for given applications independently of any accompanying reduction in root sectional area, or alternatively, increase in axial length. The disadvantage of this approach, however, is that the increased shank length adds appreciably to the weight of the blade.

The present invention has, therefore for a first objective the provision of a turbine blade having a flexible root portion which avoids the above drawback, and for a second objective the provision of a turbine blade which has a root portion constructed in such a way that it provides for improved blade dampability.

According to the present invention there is provided a blade for a turbomachine comprising an aerofoil portion, a root portion and a platform located between the aerofoil and the root portions, the platform being divided and the root partially divided by at least one slot extending between opposing flanks of the blade, the slot extending from the aerofoil side of the platform and terminating within the root so that adjacent sections of the root support adjacent sections of the platform.

Preferably the root includes a blade fixing portion and a shank disposed between the blade fixing portion and the platform, and the slot extends towards the blade fixing portion to provide a primary shank on one side thereof for supporting the aerofoil and an associated platform section, and a secondary shank on the opposing side thereof for independently supporting an adjacent platform section.

The platform edges each side of the slot may be urged into mutual contact to provide engagement surfaces for damping blade vibrations.

Also, the shanks may be adapted so that centrifugal load acting on the shanks urges the engagement surfaces of the platform sections into contact.

Preferably the secondary shank is inclined relative to the primary shank and extends between the blade fixing portion of the root and the centroid of the platform section it supports.

Preferably the secondary shank has an elastic stiffness greater than the primary shank in the plane of the engagement surfaces, and an elastic stiffness less than the primary shank in a plane perpendicular to the plane of the engagement surfaces.

In addition shims may be located along the engagement surfaces of each slot.

Figure 2:
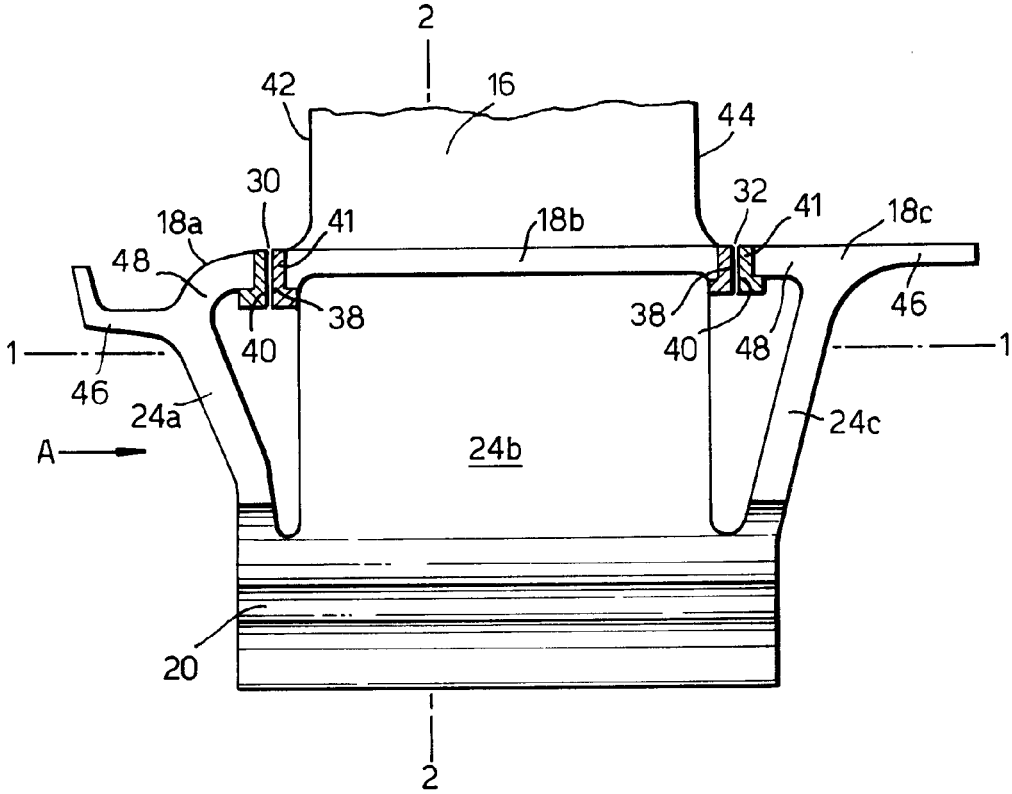
Figure 3:
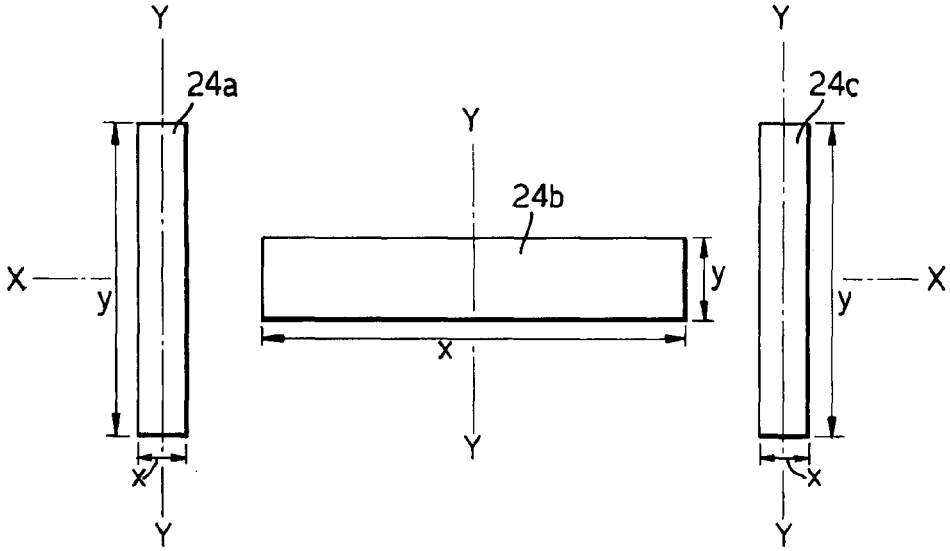
Figure 4:
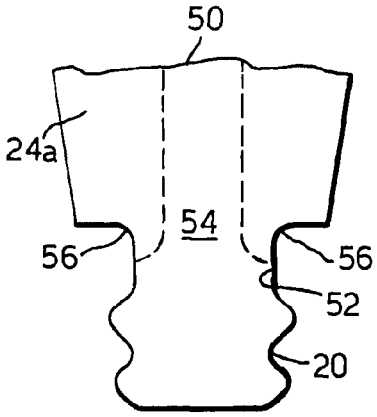
Figure 5:
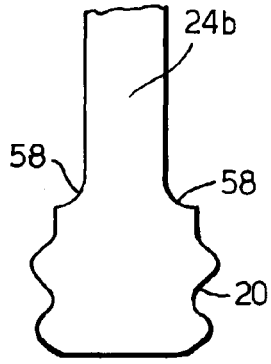

The invention will now be described in greater detail, by way of example only, with reference to the accompanying drawings, in which:

FIG. 1 is a perspective view of a turbine rotor assembly having a turbine blade according to the present invention, FIG. 2 is a partial side view of the turbine blade shown in FIG. 1, FIG. 3 is a sectional view taken along line 1-1 in FIG. 2, FIG. 4 is a partial end view in the direction of arrow A in FIG. 2, and FIG. 5 is a partial sectional view taken along line 2-2 in FIG. 2.

Referring first to FIG. 1, a shroudless turbine blade of the present invention is shown generally at 10 secured to the periphery of a disc 12 of a turbine rotor assembly. The blade 10 is of generally conventional configuration in that it comprises a root portion 14, an aerofoil portion 16, and a platform 18 located between the root and the aerofoil portions 14 and 16. The root 14 includes a conventional fir tree shaped blade fixing portion 20 which locates the blade in a correspondingly shaped axial root slot 22 formed in the disc periphery, and a shank portion 24 disposed between the blade fixing portion 20 and the platform 18. The platform extends both fore and aft of the aerofoil 16 to provide an extended flow boundary at the disc periphery, and fore and aft platform seal interface surfaces 26 and 28 at the platform axial extremities.

In accordance with the invention the platform is divided by a pair of axially spaced slots 30 and 32 which extend in parallel relationship between opposing flanks 34 and 36 of the blade. The slots extend in planes perpendicular to the main rotor axis (not shown) to divide the platform axially and provide a pair of axially facing confronting surfaces 38 and 40 at each slot location. The slots may define a gap between the confronting surfaces 38 and 40, or alternatively the surfaces may be in mutual contact. As a further alternative, and as shown in FIG. 2, surfaces 38 and 40 may be provided with shims 41 which extend at least part way along their length. The reason for this will become apparent later.

As can best be seen in FIG. 2, the slots divide the platform into three axially adjacent sections 18*a*, 18*b* and 18*c*. The forward slot 30 divides the platform immediately forward of the aerofoil leading edge 42 to separate the forward platform section 18*a* from the aerofoil, and similarly the rearward slot 32 divides the platform immediately aft of the aerofoil trailing edge 44 to separate the rearward platform section 18*c* from the aerofoil. The slots then continue into the root portion 14 where they divide the shank 24 into three corresponding axially adjacent sections 24*a*, 24*b*, and 24*c*.

Each shank section extends from the blade fixing portion of the root to support a respective one of the platform sections at a point remote from the disc periphery. The fore and aft platform sections 18*a* and 18*c* are supported independently of the main central section 18*b* by respective fore and aft shank sections 24*a* and 24*c*, and likewise the central platform section 18*b* is supported independently of the fore and aft platform extensions by the central shank section 24*b*.

The central shank 24*b* extends in a generally spanwise direction in line with the aerofoil leading and trailing edges 42 and 44, and supports the central platform section 18*b* substantially along it's length. By comparison, the fore and aft shank sections 24*a* and 24*c* extend in a generally inclined manner with respect to the central shank section 24*b*, and support the corresponding fore and aft platform sections 18*a* and 18*c* at a single point along their length. The fore and aft shank sections 24*a* and 24*c* are each joined at their distal ends to the centroid of the platform section they support, thereby to reduce any unsupported platform overhang, as indicated by reference numerals 46 and 48 in FIG. 2, to a minimum.

Referring now to FIG. 3, each shank section has a generally rectangular spanwise cross-section defined by a dimension x in the axial direction of the blade, and a dimension y in the direction of the confronting platform surfaces 38 and 40. The sectional area of each shank is determined by the blade material and the operational loading it has to support. The sectional area of the central or primary load carrying shank 24*b* is greater than that of the fore and aft or secondary shanks 24*a* because of the relatively greater proportion of the blade centrifugal load it operationally supports.

As illustrated, the central section 24*b* is dimensioned such that dimension x is greater than dimension y so that the second moment of area of the cross-section with respect to it's neutral axis Y-Y is greater than the second moment of area with respect to it's neutral axis X-X. The fore and aft shanks sections 24*a* and 24*b* are, by contrast, dimensioned such that dimension y is greater than dimension x so that the second moment of area of the respective cross-sections is greater with respect to the neutral axis X-X rather than axis Y-Y. Furthermore, the central shank section 24*b* has a greater second moment of area, and hence bending stiffness, with respect to it's Y-Y axis, than that of shanks 24*a* and 24*c*; and in a similar manner has a lower second moment of area, and bending stiffness, with respect to it's X-X axis, than shanks 24*a* and 24*c*.

As illustrated in FIG. 4, the forward shank section 24*a* tapers inwards from it's distal end 50 towards it's proximal end 52. A transition section 54 positioned at the proximal end of the shank reduces the width of the shank further. The shank width is reduced to that of the blade fixing portion by internal radii 56 formed at the distal end of the shank. The transition is such that the forward shank section 24*a* becomes assimilated with the fir tree shaped fixing portion at a point in the region of the end point of the slot 30. The geometry of the rearward shank section 24*c* is identical.

In contrast, the width of the central shank section 24*b*, shown in FIG. 5, remains approximately constant over the shank's entire spanwise extension. The only deviation occurs at the proximal end of the shank where it's width is increased to that of the blade fixing portion by external fillet radii 58. As can be determined from the dotted lines of FIG. 4, the width of the central shank 24*b* is less than that of the peripheral shanks 24*a* and 24*b* at all points on the blade.

It will be appreciated that by segregating the blade platform and shank in the manner described, the bending stiffness of the shank will be reduced, not overall, but in the sense that the fore and aft regions of the shank will no longer contribute to the bending stiffness of the central region which supports the cantilevered aerofoil. It will be recognised therefore that this reduction in stiffness will result in a corresponding increase in shank flexibility, and may therefore be applied to platform damped rotor blades of the type described, either to increase the amount of platform motion available for damping, or alternatively to maintain the same level of shank flexibility whilst reducing overall shank extension, and therefore blade weight.

Considering now the operational forces acting on the blade, it will be further recognised that additional platform damping will result from the interaction of platform surfaces 38 and 40 at the slot locations. During operation, centrifugal load generated by the fore and aft shank and platform extensions will act to urge each of the surfaces 40 into engagement with a corresponding one of the central platform section surfaces 38. When engaged the surfaces will act to damp any relative movement of the adjacent platform sections due to flexure of the blade.

The invention claimed is:

1. A blade for a turbomachine comprising an aerofoil portion, a root portion and a platform located between the aerofoil and the root portions, the platform being divided and the root partially divided by at least one slot extending between opposing flanks of the blade, the slot extending from the aerofoil side of the platform and terminating within the root so that adjacent sections of the root support adjacent sections of the platform.

2. A blade as claimed in claim 1 wherein the root includes a blade fixing portion and a shank disposed between the blade fixing portion and the platform, and whereby the slot extends towards the blade fixing portion to provide a primary shank on one side thereof for supporting the aerofoil and an associated platform section, and a secondary shank on the opposing side thereof for independently supporting an adjacent platform section.

3. A blade as claimed in claim 2 wherein the platform edges on each side of the slot are adapted to be urged into mutual contact to provide engagement surfaces for damping blade vibrations.

4. A blade as claimed in claim 3 wherein adjacent shanks are adapted so that, in use, centrifugal load acting on the shanks urges the engagement surfaces of the platform sections into contact.

5. A blade as claimed in claim 4 wherein the secondary shank is inclined relative to the primary shank.

6. A blade as claimed in claim 5 wherein the secondary shank extends between the blade fixing portion of the root and the centroid of the platform section it supports.

7. A blade as claimed in claim 3 wherein the secondary shank is adapted to have an elastic stiffness greater than the primary shank in the plane of the engagement surfaces.

8. A blade as claimed in claim 3 wherein the secondary shank is adapted to have an elastic stiffness less than the primary shank in a plane perpendicular to the plane of the engagement surfaces.

9. A blade according to claim 3 wherein shims are located along the engagement surfaces of each slot.

10. A blade according to claim 1 wherein a first slot is provided at the blade leading edge, and a second slot is provided at the blade trailing edge.

* * * * *